US011055939B2

(12) United States Patent
Reime

(10) Patent No.: US 11,055,939 B2
(45) Date of Patent: Jul. 6, 2021

(54) SECURING AND/OR LOCKING SYSTEM AND CORRESPONDING METHOD

(71) Applicant: Gerd Reime, Bühl (DE)

(72) Inventor: Gerd Reime, Bühl (DE)

( * ) Notice: Subject to any disclaimer, the term of this patent is extended or adjusted under 35 U.S.C. 154(b) by 454 days.

(21) Appl. No.: 16/307,037

(22) PCT Filed: Jan. 27, 2017

(86) PCT No.: PCT/EP2017/051724

§ 371 (c)(1),
(2) Date: Dec. 4, 2018

(87) PCT Pub. No.: WO2017/129724

PCT Pub. Date: Aug. 3, 2017

(65) Prior Publication Data

US 2019/0206168 A1 Jul. 4, 2019

(30) Foreign Application Priority Data

Jan. 27, 2016 (DE) ..... 10 2016 201 198.7

(51) Int. Cl.
*G07C 9/00* (2020.01)
*E05B 19/26* (2006.01)
*E05B 19/00* (2006.01)

(52) U.S. Cl.
CPC ..... *G07C 9/00722* (2013.01); *G07C 9/00698* (2013.01); *G07C 9/00912* (2013.01);
(Continued)

(58) Field of Classification Search
CPC ..... G07C 9/00722; G07C 9/00698; G07C 9/00912
(Continued)

(56) References Cited

U.S. PATENT DOCUMENTS 4,849,749 A * 7/1989 Fukamachi ..... G07C 9/00738 340/5.66
5,493,882 A * 2/1996 Jasper ..... G07C 9/00912 70/278.4

(Continued)

FOREIGN PATENT DOCUMENTS

GB 2072742 A 10/1981
GB 2085064 A 4/1982

(Continued)

OTHER PUBLICATIONS

International Preliminary Report on Patentability for corresponding application PCT/EP2017/051724 filed Jan. 27, 2017; Report dated Jul. 31, 2018.

(Continued)

*Primary Examiner* — Kerri L McNally
(74) *Attorney, Agent, or Firm* — Cantor Colburn LLP

(57) ABSTRACT

A method for securing and/or locking an object, and a related system, the method including introducing into a key receiver a metal key element that is provided along its longitudinal direction at least in part with at least one first code, reading of the at least one first code by at least one reader unit in the key receiver, rotating the at least one metal key element in and in relation to the key receiver by a user, therein producing a relative rotary movement, detecting the relative rotary movement, converting the relative rotary movement as detected into a display signal that is variable with rotation, communicating the display signal to a display, interactively setting a further code on the display by the user, by rotating the at least one metal key element, and actuating the securing and/or locking and unlocking of the object in dependence on the further code.

11 Claims, 2 Drawing Sheets

(52) U.S. Cl.
CPC ..... *E05B 19/0047* (2013.01); *E05B 19/26* (2013.01); *G07C 9/00714* (2013.01)

(58) Field of Classification Search
USPC ..... 340/542
See application file for complete search history.

(56) References Cited

U.S. PATENT DOCUMENTS 6,255,957 B1 * 7/2001 Sonderegger ..... E05B 19/22 340/5.32
8,468,861 B2 * 6/2013 Pukari ..... G07C 9/00309 70/278.7
2003/0159480 A1 * 8/2003 Pinkhasov ..... E05B 19/205 70/394
2006/0226948 A1 * 10/2006 Wright ..... G07C 9/00309 340/5.25
2007/0033415 A1 * 2/2007 Yumoto ..... E05B 47/026 713/186
2012/0207265 A1 * 8/2012 Weinstein ..... E05B 19/22 377/15
2012/0324968 A1 * 12/2012 Goren ..... E05B 41/00 70/280
2015/0269799 A1 * 9/2015 Martinez ..... G07C 9/00182 70/277

FOREIGN PATENT DOCUMENTS

JP 2003184368 A 7/2003
JP 2006118186 A 5/2006
WO 0177467 A1 10/2001
WO 2015118729 A1 8/2015
WO 2016062407 A1 4/2016

OTHER PUBLICATIONS

International Search Report for corresponding application PCT/EP2017/051724 filed Jan. 27, 2017; Report dated Apr. 5, 2017.
Written Opinion of the International Searching Authority for corresponding application PCT/EP2017/051724 filed Jan. 27, 2017; Report dated Apr. 5, 2017.

* cited by examiner

SECURING AND/OR LOCKING SYSTEM AND CORRESPONDING METHOD

CROSS REFERENCE TO RELATED APPLICATIONS

The present application is the U.S. National Stage of International Patent Application Number PCT/EP2017/051724 which relates to and claims the priority of the German patent application 10 2016 201 198.7, filed on 27 Jan. 2016, the disclosure of which applications are hereby expressly incorporated by reference into the subject matter of the present application in their entirety.

TECHNICAL FIELD

The disclosure relates to a method for securing and/or locking an object and to a securing and/or locking system for an object.

BACKGROUND

For the purpose of protecting objects, various securing and/or locking methods and associated systems are known that are intended to protect objects or information from unauthorized access. In particular, mechanical or electronic locks having a corresponding mechanical or electronic key are known, wherein, once the mechanical code of the key or an electronic code read by a reader unit has been entered, the lock can be unlocked. Because no lock is ever entirely secure, and with the necessary criminal energy and technical aids any lock can be cracked, over time the technologies of locks and locking systems have been developed to a greater and greater extent.

In the case of a purely mechanical lock, mechanical unlocking for example of a door is achieved using a mechanical key. The force for moving the bolt results from the movement of the mechanical key, for example a rotary movement, once the shape of the key in the lock has been scanned and corresponding mechanical features match the lock specification. Locking systems of this kind are widespread, for example in the form of a cylinder lock.

In the case of an electrical locking system, an electrical or hydraulic procedure moves the bolts, or enables manual actuation of the bolt. The key that fits the lock has a code that is read by a reader unit, with the result that a motor control for example performs the unlocking operation after the appropriate data words have been entered. This is the case for example with transponder keys, in which an electronic key exchanges data with a corresponding electronic lock.

A: Mechanical Lock

Typically, a mechanical key carries mechanical devices that are visible from the outside and that are correspondingly scanned in the lock. If the key and the lock match, locking is enabled, with the result that turning the key can trigger a further mechanical procedure.

Advantage of Mechanical Locks:

They are relatively simple to manufacture, and keys may be passed to other persons without problems. Usually, the keys are made of metal and also withstand high temperatures, for example in the event of a fire.

The disadvantage of locks of this kind consists in so-called lock picking, that is to say opening a mechanical lock using appropriate methods and tools. The fact that there are even official championships for this demonstrates the insecurity of locks of this kind. Moreover, mechanical keys are typically easy to copy, since the key's mechanical "information" is openly shown.

A further type of lock is the combination lock, in which entering an appropriate number triggers an opening mechanism.

Disadvantage: passing on the combination "key" is problematic, since the person receiving it may have to note a relatively long sequence of numbers.

Numbers may be forgotten, in particular when there is time pressure.

B: Electronic Lock:

The key of an electronic lock comprises electronic components that exchange information by radio or optical link when a magnetic card or the key is brought close to the lock, or in the event of manual activation. If access is authorized, a corresponding opening or enabling mechanism is then actuated electrically, for example by way of a servo motor.

Advantage of Electronic Lock:

Data may be managed in a central processor, for example ideally as a time-detection system. (Electronic) lock picking is difficult or impossible.

Disadvantage of electronic keys: mechanically sensitive, and can easily become faulty. May be obtained by espionage. Does not withstand high temperatures; in the event of a fire an electronic key is typically irreparably destroyed.

The more difficult it is to pick a lock or to copy a key, the more secure the locking system. In the case of cylinder locks which are usual today, a key may be reworked within a few minutes without any problems at all by any specialist locksmith or suitable service provider such as are to be found today in many shopping centers. Even high-security keys only provide "higher" levels of security to the extent that they are not (legally) permitted to be reworked by key service providers because of corresponding regulations. From a technical point of view, copying a key of this kind is hardly ever a problem. There is thus only security against forgery because of corresponding agreements. Nowadays, even a photo of a key taken from some distance away is sufficient to make a complete functional copy of the key using a 3D printer.

WO 01/77467 A1 discloses a key and lock mechanism that makes it possible to display the status of the lock on the key without generating a display signal. Rather, magnets are directly displaced and serve as the display. The magnets are not set interactively, and do not represent any coding for the lock. They can merely be moved to different display positions, at the same time as the rotation for locking or opening the lock. Moreover, the securing and/or locking or unlocking of the object is not actuated in conjunction with the magnets. Rather, actuation is performed directly in conjunction with rotation of the key, wherein the display position changes at the same time. The display provided by the magnets does not have any effect on the locking procedure itself.

BRIEF SUMMARY

Taking this prior art as a starting point, the disclosure provides a method for securing and/or locking an object, and a securing and/or locking system, with which an entered code can be used with a key, and a further code can be used by interaction with the user, for the purpose of securing.

A method is also provided for securing and/or locking an object, and a securing and/or locking system for an object.

According to the method, a key element is provided that carries a first code that is detected in conjunction with a reader unit. This is performed by introducing the key element into a key receiver. If the key element is then rotated in the key receiver, in addition the relative movement of the key in respect of the key receiver is detected, and a display is activated as a result of the relative movement. However, it is also possible for the display to be activated simply by introducing the key element into the key receiver. A further code may be entered by means of the display, by interaction with the user. Thus, different codes can be used with the very same key element, for the purpose of enhanced protection of the object. In this case, the first code is preferably not detectable, visible or perceptible to persons without further aids, while as a result of the rotary movement with the interposition of the display arrangement, as a human-machine interface, the further code generates for example numerical values that can be perceived by the user. Thus, there is so to speak an authentication by the first code, which is then actuated by interaction with the person by way of a further code, such that a corresponding unlocking can only then take place. Thus, the actual unlocking, locking and/or actuation of the securing are performed in dependence on the further code. Because the code and the further code are checked, there is a double security, wherein unlocking, locking and/or actuation of the securing are only performed if the detected code and the detected further code are correct. Unlocking, locking and/or actuation of the securing are performed in chained sequence, that is to say in dependence on the detected code and the detected further code. The code and the further code are each read in or detected in particular by a common reader unit, or for each code by a separate reader unit. The order in which the codes are checked can be varied. It is possible to check first the further code and then the code, or vice versa, or to check both at the same time. It is thus unimportant whether the code triggers the further code and the latter triggers the unlocking, locking and/or actuation of the securing, or vice versa, or both codes perform the triggering. As a result, unlocking, locking and/or actuation of the securing is/are performed if both codes are entered correctly, detected and processed accordingly. The additional further code thus doubles the authentication of the user and hence results in enhanced security.

Preferably, the further code is entered by alternately rotating the key element in opposite directions, as known for example in the technology of safes, for entering numerical codes. Here, the numerical code may comprise numbers, including multi-digit numbers. However, the numerical code alone is not sufficient, since it can only be retrieved or entered using the key element. In this case, preferably the first code may also be used to generate the further code. If the rotary movement of the first code in the key receiver is detected, this generates a display signal for the display arrangement that form the interface with the person.

Preferably, the reader unit that is already being used to detect the first code can also be used to detect the further code.

In a preferred embodiment, the first code is entered by introducing the key element into the key receiver, wherein a reader unit reads the first code. In this case, a sensor that detects the position of the key element may be provided, such that for example either at the end position of the key element or indeed at another predetermined position the fact that the code has been entered is detected. Here, it is possible through an additional interaction to display to the user the fact that the predetermined position or the end position has now been reached, such that the further code can only then be generated by the relative rotary movement. Here, for the entry of individual parts of the code, it is conceivable to hold for example the key element at a particular (numerical) value that is displayed on the display element for a particular period, for example 1 second, in order in this way to confirm the value. Similarly, however, a piezo element may be provided for example at the end of the key receiver, such that the displayed value is activated by pressing lightly on the key element as a part of the code to be entered.

Advantageously, reading the first code and/or the further code is performed without any mechanical interaction of the key element with the reader unit or the key receiver. The key element may be a metal bar of circular cross section that is merely rotated in a circular keyhole. Thus, it is not possible to copy the code in the key mechanically either.

A corresponding securing and/or locking system comprises a key receiver and a metal locking element with a code along its longitudinal extent. A reader unit is provided for detecting the code. In addition, devices for detecting a relative rotary movement between the key element and the key receiver, and devices for converting the detected movement into a corresponding display signal are provided. The display arrangement then provides an interactive interface with a user, so that a further code can be entered by the user following the rotation, using the interface defined by the display arrangement. This makes it possible to enter a code that is inherent in the key on the one hand, but at the same time also to enter a code known only to the user, by interaction with the user, using the very same key element. Because this further code is likewise only on the key element and in the user's head, the possibilities for security are enhanced.

The display arrangement may preferably be provided either at a spacing from the key receiver, such as on a separate display or indeed a separate device—an interface with a mobile telephone would for example also be conceivable—or else, as is already usual nowadays in some safes, they may be arranged as a ring of numbers, for example also directly concentrically with the key receiver. In this case, codes comprising a plurality of values or numbers may also be entered. This also results in additional further possibilities for security, for example in connection with an additional code by way of the additional display unit.

Preferably, the further code is also formed by the first code on the key element in that the first code is in the first instance read along its longitudinal extent and in the second instance the rotation of this first code is detected and is utilized to enter the further code by way of the display arrangement, by rotating the key element. The codes may preferably be read using the very same reader unit, but it is also possible to provide different reader units. This enables a simple construction of the system, with few resources.

Moreover, by way of a corresponding sensor arrangement that is provided as a way of detecting position, it is possible to make the enabling of entry of the further code dependent on the fact that the first code has been fully entered and/or the fact that a particular position, either the end position or an intermediate position, has been adopted by the key element in the key receiver.

Further advantages are apparent from the subclaims and the description given below of a preferred exemplary embodiment.

BRIEF DESCRIPTION OF THE FIGURES

The disclosure is explained in more detail below with reference to an exemplary embodiment that is illustrated in the attached Figures, in which.

DETAILED DESCRIPTION

The disclosure is now explained in more detail by way of example, with reference to the attached drawings. However, the exemplary embodiments are only examples, which are not intended to restrict the inventive concept to a particular arrangement. Before the disclosure is described in detail it should be pointed out that it is not restricted to the respective constituent parts of the device and the respective method steps, since these constituent parts and method may vary. The terms used here are merely intended to describe particular embodiments and are not used restrictively. Moreover, where the singular or the indefinite article is used in the description or the claims, this also refers to a plurality of these elements unless the overall context unambiguously indicates otherwise.

The Figures show a securing and/or locking system for an object 2.1 such as a door, a safe or another object to be protected. According to FIG. 2, a key receiver 2.2 is provided directly on the object 2.1 and cooperates with a metal locking element 1.1. In principle, however, the key receiver may also be provided at a different location, outside the object 2.1, in order for example to allow the object to be unlocked at a spacing from the object and/or remotely.

Figure 1:
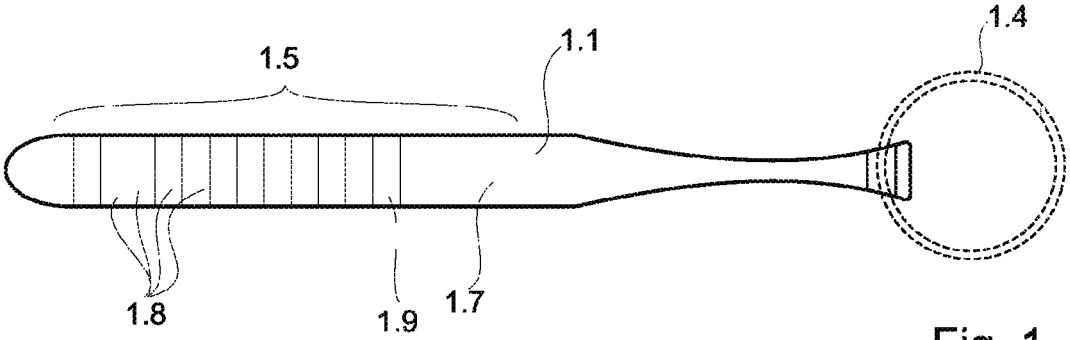
FIG. 1 shows a key element according to the disclosure in side view, with the code indicated.

The key element 1.1 is illustrated in FIG. 1. The metal key element 1.1 has along its longitudinal extent, in a code region 1.5, a first code 1.8 that is formed by different code zones. Also provided here is an end zone 1.9 that defines the termination region of the code and can be used for example for detecting the position by way of the sensor 3.3. Moreover, the key element can include a keyring 1.4 on which the key is to be fastened.

In the embodiment described here, a key element 1.1 is used that comprises a solid, preferably single and thus one-piece metal part without any structures that are visible or perceptible by touch. In the exemplary embodiment, the key comprises a short stainless steel bar having for example a length of 70 mm and a diameter of 8 mm. The end of this stainless steel bar is concavely shaped to give it better handlability and is provided with a hole for the conventional keyring 1.4. The end of the key element 1.1 that is pushed into the key receiver 2.2 is rounded.

A key element of this kind is known from prior international application WO 2016/062407 A1, the disclosure of which is hereby expressly also incorporated into the subject matter of the present application by reference. The relevant content of that application is summarized again below.

The key receiver in the exemplary embodiment comprises a round or square stainless steel cylinder, with a front plate 3.4 at one end and electrical terminals 3.6 at the other end. The "keyhole" of the key receiver 2.2 is a round opening in the front plate. Located in the interior of the cylinder is a reader unit 3.2 that scans the key element 1.1 by way of corresponding sensors and reads off the first code 1.8. The key element 1.1 itself is guided freely in a tube of the key receiver 2.2 that has an internal diameter only a little larger than the external diameter of the key element 1.1. The key element has no mechanical interaction with the key receiver 2.2. Nor is there any electrical contact. For the purpose of actuation, the key element 1.1 is merely introduced into the key receiver 2.2 in any desired position as far as it will go, or until it reaches a predetermined position. Once the corresponding first code of the key element has been read off, a further procedure may be triggered.

The key element 1.1 is encoded by making a quantum-technical change to the material of the key body, deep in the key body. Cryptographic information of the key number is encoded in these changes. In the exemplary embodiment of the key body that is 70 mm long and has a diameter of 8 mm according to FIG. 1, more than 500 billion different codes may be accommodated. The change in the structure of the key element 1.1 is not visible externally. This means that an impression cannot simply be taken of a key element 1.1 manufactured in this way. Mechanical changes for example by filing or sawing at the surface have no effect on the function. The same applies to deformations, provided the key element 1.1 can still be introduced into the key receiver 2.2. It is also possible to work on the outside of the key in any desired way, for example by anodization, laser machining, polishing, printing or similar surface coating, and thus to change it. It is also possible to incorporate key labelling, promotional material, etc. into the surface by way of deep stamping.

The code 1.8 is formed in the code region 1.5 by quantum-physical changes to the metal microstructure of the solid metal body of the key 1.1 that are scannable without mechanical interaction. Changes to the metal microstructure of this kind result in a change in the energy exchange, in particular with an alternating magnetic field. This change may be measured by evaluating the hysteresis losses, that is to say they are scannable electromagnetically. At the same time, these changes are not perceptible by people with the naked eye or without further aids, in particular being neither visible nor perceptible by touch. Externally, the key element 1.1 has rather the appearance for example of a round bar. The changes are within the mesoscopic range. In solid state physics, a transitional range lying between the microscopic and the macroscopic is called mesoscopic. Put simply, the mesoscopic range extends on a length scale from about a nanometer to about a micron. A multiplicity of these changes made to the metal microstructure then together forms a first code 1.8. In this way, each code zone may also have a plurality of items of information incorporated next to one another along the periphery of a key element. This means that each partial item of information of the code comprises a multiplicity of mesoscopic changes that are not perceptible externally. Typically, these changes are from 0.1 to 2 mm in length or in diameter.

Located close to the keyhole of the key receiver 2.2 is a sensor 3.3 that detects the fact that the key element has been introduced and hence activates the reader unit 3.2 for reading off the first code 1.8 of the key element 1.1. Using this sensor 3.3 and/or the reader unit 3.2 as ways of detecting position, it is possible to determine whether the key element has reached its end position or a predetermined position that then allows a further procedure.

The reader unit 3.2 for reading the first code 1.8 detects the first code, wherein this procedure can be performed both when the key element is introduced into the insertion opening 3.5 and also once the key reaches a particular position. Moreover, a detecting arrangement for detecting a relative rotary movement between the key element 1.1 and the key receiver 2.2 is provided. This detecting arrangement may be for example the reader unit 3.2. Using a converting arrangement for converting the detected rotary movement into a display signal that is variable with the rotary movement, a display is obtained from display arrangement 2.4 or 2.5. The converting arrangement may be for example part of the controller 2.6 and be formed by a circuit that converts the electrical signal generated by the relative rotary movement into a control signal for the display arrangement 2.4, 2.5. The display arrangement serves to display the display signal for example visually or acoustically or indeed by touch, wherein the display arrangement thus forms an interactive interface with a user. In this way, the key element 1.1 may be utilized as an input arrangement for entering a further code following rotation of the key element 1.1 by the user, using the interactive interface. Thus, the further code that is enterable interactively by the user is detected, in particular as a result of rotation of the key element by the user.

Figure 2:
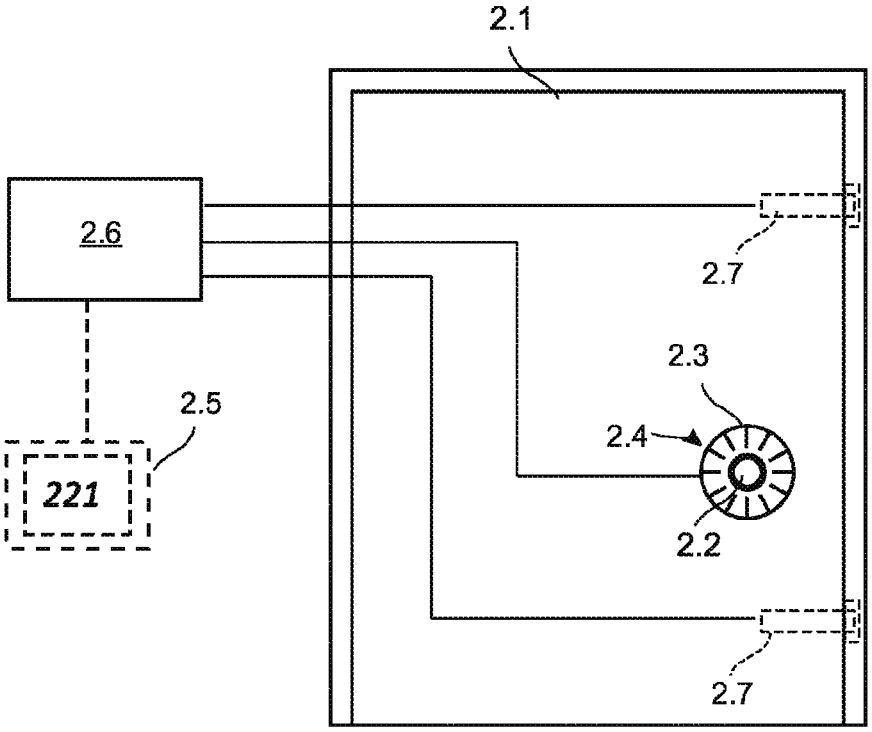
FIG. 2 shows an object to be protected, with a key receiver, in a front view.
Figure 3:
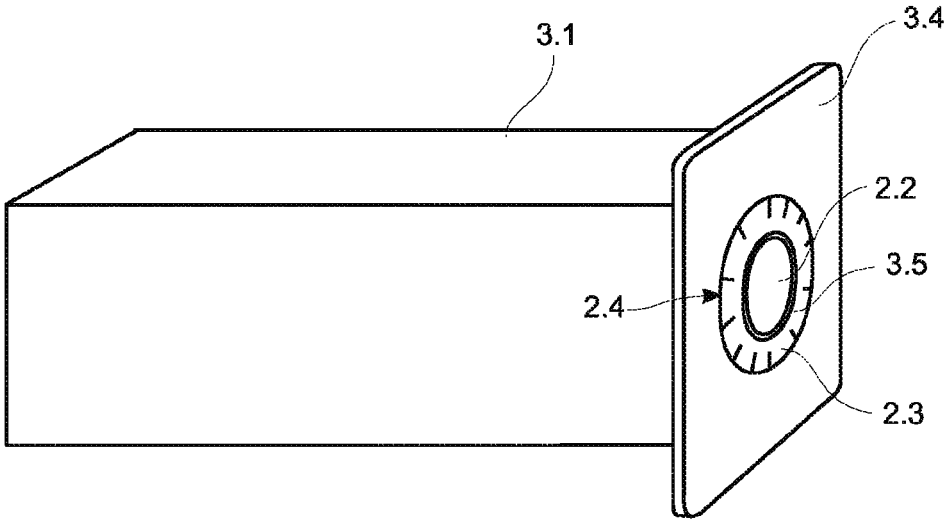
FIG. 3 shows a three-dimensional view of a housing for a key receiver.
Figure 4:
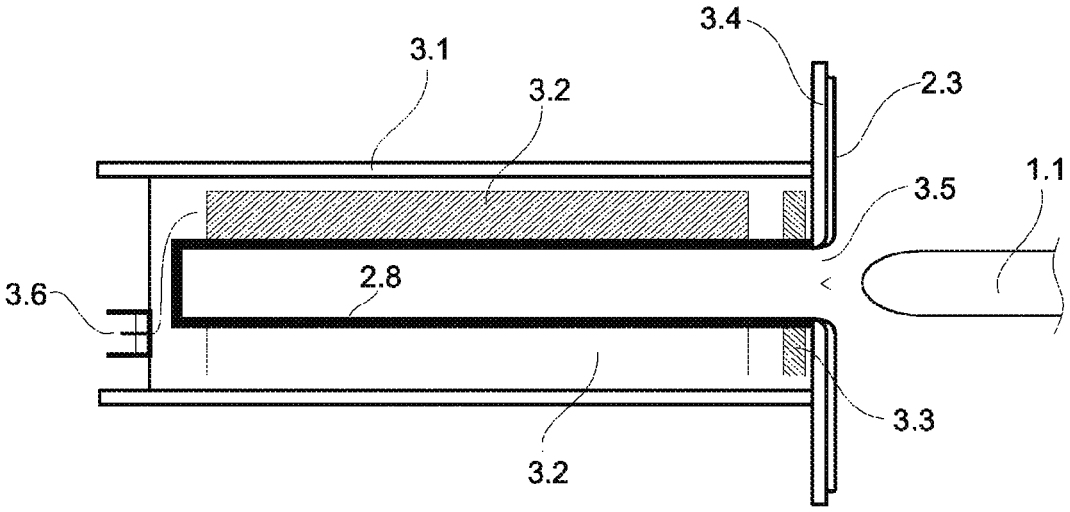
FIG. 4 shows a section through the housing according to FIG. 3.

Thus, the user introduces the key element 1.1 into the key receiver 2.2 according to FIG. 2. If the first code 1.8 is then detected, the controller 2.6 preferably enables a further procedure, which then initiates detection of the relative rotary movement. Here, the position in which the key element 1.1 has been introduced is of no significance. From the starting point when the first code has been detected, the user can now rotate the key element, with a preferably not previously visible display appearing for example on the front plate 3.4. This display may be for example a ring 2.3, according to FIG. 2, as the display arrangement 2.4, arranged concentrically around the key receiver 2.2. The user can now perceive numerical values on this ring 2.3 as the key element is rotated, as in a combination lock, and hence enter certain numbers. These numbers are displayed to the user either by way of the ring as the display arrangement and/or by way of alternative display arrangements 2.5 for example, such that the user can enter a further code. In principle, non-visual displays are also conceivable. In order to activate the parts of the code, that is to say for example certain numerical values, it is possible to hold for example the key element 1.1 at a particular (numerical) value that is displayed on the display element for a particular period, for example 1 second, in order in this way to confirm the value. Similarly, however, a piezo element may be provided for example at the end of the key receiver, such that the displayed value is activated by pressing lightly on the key element as a part of the code to be entered. Other ways of activating, such as mechanical switches in or outside the key receiver, are likewise conceivable. Once the further code has been entered, the controller 2.6 can for example enable the locking arrangement 2.7.

The display arrangement 2.5 is preferably arranged at a spacing from the key receiver 2.2, wherein for example a transfer to a mobile telephone that has an additional security by way of a code is also conceivable. Likewise, the display arrangement 2.4 may also take the form of the ring 2.3 by itself.

In principle, it is possible for the key element 1.1 to have a first code 1.8 in the longitudinal direction and a second code in the peripheral direction. However, it is likewise possible for the further code to be formed by the first code 1.8 by itself, that is to say on introduction in the longitudinal direction the first code is read, but as soon as the first code 1.8 is rotated in relation to the key receiver 2.2 this allows the further code to be determined. The relative rotary movement between the key element 1.1 and the key receiver 2.2 is determined and evaluated for the purpose of determining the further code. In this case, for example a numerical code can be entered by the display arrangement 2.4, 2.5, by the key element 1.1 being rotated alternately in opposite directions. This is in principle already known in a similar manner from the known combination locks on safes, even though in that case a predetermined zero point exists, whereas here the rotary movement can be performed in one or the other direction from the position in which it was introduced, which may be any desired position.

According to the method, for the purpose of securing and/or locking an object, at least one metal key element 1.1 that is provided along its longitudinal direction at least in part with at least one first code 1.8 is introduced into a key receiver 2.2.

Either during the introduction or in the introduced condition, or as soon as a predetermined position is reached, the at least one first code 1.8 is read by a reader unit 3.2. If during this the first code 1.8 is identified as correct, further procedures can be activated and permitted.

Then, the key element 1.1 is rotated in relation to the key receiver 2.2 by a user, wherein a relative rotary movement is produced. This relative rotary movement is detected for example by the reader unit 3.2 or indeed by a further reader unit. The detected rotary movement is then converted into a display signal that is variable with rotation, that is to say values are produced that can be displayed then by way of a display arrangement 2.4, 2.5. Thus, the display signal that is communicated to the display arrangement 2.4, 2.5 serves for a preferably visual display and is hence an interactive interface with a user. The user can then interactively set a further code on the display arrangement 2.4, 2.5, by rotating the key element 1.1 in relation to the key receiver, where appropriate also multiple times in different directions. As a result, a first code is read in that authenticates further procedures and is already in the key, whereas the further code can then be entered using the same key element, wherein the code is not contained on the key element as an additional code, however, but is entered by the user.

For the purpose of generating the further code, the rotary movement of the first code 1.8 is detected by a reader unit preferably on the key element 1.1, wherein the reader unit is preferably the very same reader unit 3.2 that has already detected the first code 1.8. Moreover, using a sensor 3.3 it is also possible to ensure entry of the first code 1.8 in that the key element 1.1 is introduced into the key receiver and hence presented to the reader unit only as far as a predetermined position or indeed as far as the end position. As a result, the key element 1.1 can be rotated for the purpose of entering the further code only once the key element 1.1 has been introduced as far as the predetermined position or as far as the end position. Preferably, the first and/or also the further code is read without any mechanical interaction between the key element 1.1 and the reader unit 3.2 or the key receiver 2.2.

It is self-evident that this description can be subject to the widest variety of modifications, changes and adaptations, which belong within the scope of equivalents to the accompanying claims.

The invention claimed is:

1. A method for securing and/or locking an object, comprising the steps of:

introducing into a key receiver at least one metal key element that is provided along its longitudinal direction at least in part with at least one first code, reading of the at least one first code by at least one reader unit in the key receiver, rotating the at least one metal key element in and in relation to the key receiver by a user, therein producing a relative rotary movement, detecting the relative rotary movement, converting the relative rotary movement as detected into a display signal that is variable with rotation, communicating the display signal to a display, interactively setting a further code on the display by the user, by rotating the at least one metal key element, actuating the securing and/or locking and unlocking of the object in dependence on the further code.

2. The method according to claim 1, comprising the step of entering the further code by alternately rotating the at least one metal key element in the key receiver in opposite directions.

3. The method according to claim 1, wherein the further code is generated in that the rotary movement of the first code of the at least one metal key element is detected by a further reader unit or by the at least one reader unit for detecting the first code.

4. The method according to claim 1, wherein the first code is entered by introducing the key element into the at least one reader unit, until a predetermined position or an end position in the at least one reader unit is reached.

5. The method according to claim 4, wherein the rotation of the at least one metal key element generates the further code, after the at least one metal key element has been introduced, until the predetermined position or the end position is reached and the predetermined position or the end position has been detected.

6. The method according to claim 1, wherein reading at least one of the first code or the further code is performed without any mechanical interaction with the at least one reader unit or the key receiver.

7. A securing and/or locking system for an object, wherein the securing and/or locking system comprises a key receiver, at least one metal key element comprising a first code along its longitudinal extent, at least one reader unit for reading the first code of the at least one metal key element in the key receiver, a detecting arrangement for configured to detect a relative rotary movement between the at least one metal key element and the key receiver, a converter configured to convert the relative rotary movement as detected into a display signal that is variable with the relative rotary movement, a display configured to display the display signal, wherein the display comprises an interactive interface with a user, wherein the at least one metal key element is an input arrangement for entering a further code caused by a rotation of the at least one metal key element by the user, using the interactive interface, an actuator configured to actuate the securing and/or locking and unlocking of the object in dependence on the further code.

8. The system according to claim 7, wherein the display is arranged at a spacing from the key receiver.

9. The system according to claim 7, wherein the display is arranged as a ring around the key receiver.

10. The system according to claim 7, wherein the detecting arrangement comprises a further reader unit or the reader unit for reading the first code.

11. The system according to claim 7, wherein a further detector configured to detect the position of the at least one metal key element in the key receiver is provided, and wherein an arrangement for enabling entry of the further code is provided that enables entry by an enabling signal as soon as the further detector detects a predetermined position or an end position of the at least one metal key element.

* * * * *